US007182992B2

(12) United States Patent
Ausen et al.

(10) Patent No.: US 7,182,992 B2
(45) Date of Patent: Feb. 27, 2007

(54) HOOK FIBER

(75) Inventors: Ronald W. Ausen, St. Paul, MN (US); Jayshree Seth, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 151 days.

(21) Appl. No.: 10/780,396

(22) Filed: Feb. 17, 2004

(65) Prior Publication Data

US 2005/0181171 A1 Aug. 18, 2005

(51) Int. Cl.
*A44B 18/00* (2006.01)

(52) U.S. Cl. ..... 428/100; 428/399; 428/400; 24/449; 24/442

(58) Field of Classification Search ..... 428/100, 428/364, 399, 400; 24/442, 449, 450, 452; 264/147, 145, 210.1
See application file for complete search history.

(56) References Cited

U.S. PATENT DOCUMENTS

| | | | |
|---|---|---|---|
| 3,266,113 | A | 8/1966 | Flanagan, Jr. |
| 3,522,637 | A | 8/1970 | Brumlik |
| 3,557,413 | A | 1/1971 | Engle |
| 3,655,855 | A | 4/1972 | Brumlik |
| 3,808,646 | A | 5/1974 | Brumlik |
| 3,833,972 | A | 9/1974 | Brumlik |
| 3,879,835 | A | 4/1975 | Brumlik |
| 3,889,322 | A | 6/1975 | Brumlik |
| 3,922,455 | A | 11/1975 | Brumlik |
| 3,927,443 | A | 12/1975 | Brumlik |
| 3,981,051 | A | 9/1976 | Brumlik |
| 3,991,534 | A | 11/1976 | Brumlik |
| 4,001,366 | A | 1/1977 | Brumlik |
| 4,056,593 | A | 11/1977 | de Navas Albareda |
| 4,169,303 | A | 10/1979 | Lemelson |
| 4,180,890 | A | 1/1980 | Brumlik |
| 4,189,809 | A | 2/1980 | Sotos |
| 4,189,890 | A | 2/1980 | Bains et al. |
| 4,198,459 | A | 4/1980 | Brumlik |
| 4,198,734 | A | 4/1980 | Brumlik |
| 4,894,060 | A | 1/1990 | Nestegard |
| 5,077,870 | A | 1/1992 | Melbye et al. |
| 6,000,106 | A | 12/1999 | Kampfer et al. |
| 6,132,660 | A | 10/2000 | Kampfer |
| 6,209,177 | B1 | 4/2001 | Murasaki |
| 2004/0261232 | A1 | 12/2004 | Kurtz, Jr. et al. |

*Primary Examiner*—Alexander S. Thomas
(74) *Attorney, Agent, or Firm*—William J. Bond

(57) ABSTRACT

The present invention is directed at a hook strand. These hook strands have a base layer with first top face and a second bottom face and two side faces. Hook elements on the strand extend from at least one face and the hook elements have engaging arms that extend at an angle of from 1 to 90 degrees relative to the longitudinal extent of the strands.

18 Claims, 6 Drawing Sheets

HOOK FIBER

SUMMARY OF THE INVENTION

The present invention concerns extrusion formed hook fibers for use with hook and loop type fasteners.

BACKGROUND OF THE INVENTION

A film extrusion process for forming hooks is proposed, for example, in U.S. Pat. Nos. 4,894,060 and 4,056,593, which permits the formation of hook elements by forming rails on a film backing. Instead of the hook elements being formed as a negative of a cavity on a molding surface, as is the more traditional method, the basic hook cross-section is formed by a profiled film extrusion die. The die simultaneously extrudes the film backing and rib structures. The individual hook elements are then preferably formed from the ribs by cutting the ribs transversely, followed by stretching the extruded strip in the direction of the ribs. The backing elongates but the cut rib sections remain substantially unchanged. This causes the individual cut sections of the ribs to separate each from the other in the direction of elongation forming discrete hook elements. Alternatively, using this same type extrusion process, sections of the rib structures can be milled out to form discrete hook elements. With this profile extrusion, the basic hook cross section or profile is only limited by the die shape and hooks can be formed that extend in two directions and have hook head portions that need not taper to allow extraction from a molding surface.

BRIEF DESCRIPTION OF THE INVENTION

The present invention is directed at a hook strand. These hook strands have a base layer with first top face and a second bottom face and two side faces. Hook elements on the strand extend from at least one face and the hook elements have engaging arms that extend at an angle of from 1 to 90 degrees, preferably 30 to 90 degrees relative to the longitudinal extent of the strands.

A preferred method for forming the invention hook strands generally includes extruding a thermoplastic resin through a die plate, which die plate is shaped to form a base film layer and spaced ridges or ribs projecting from one or both surfaces of the base layer. The spaced ridges or ribs formed by the die are precursors used to form the set of hooks on one or both the top and/or bottom face of the strands. The hooks are formed by at least partially cutting the ribs or ridges and stretching the ridges and/or the base layer to cause the cut portions to separate. Further, sets of hooks on the side faces of the strands can also be formed by transversely cutting the base layer at spaced locations along a length, at a transverse angle to the ridges or ribs, to form discrete cut base portions. Subsequently, longitudinal stretching of uncut portions of the base layer or the ridges (in the direction of the ridges or the machine direction) separates these cut portions of the ridges and/or backing, which cut portions then form the hook structures. The stretching can also orient (molecular orientation created by stretching) the material forming the strand base layer increasing the strength and flexibility of the strands.

In a preferred method, a die plate is shaped to form a base film layer and spaced ridges, ribs or hook forming elements projecting from both surfaces of the base layer and/or hook forming lip structures on the base layer. The initial hook members are formed by transversely cutting ridges and/or the base at spaced locations along their lengths to form discrete cut portions of the base and the ridges. Subsequently, longitudinal stretching of the ridges or backing layer (in the direction of the ridges in the machine direction) separates these discrete cut portions, which cut portions then form the spaced apart hook members, that have a cross-sectional shape identical to the cross-sectional shape of the ridges or cut base portion.

BRIEF DESCRIPTION OF THE DRAWINGS

The present invention will be further described with reference to the accompanying drawings wherein like reference numerals refer to like parts in the several views, and wherein.

DETAILED DESCRIPTION OF THE PREFERRED EMBODIMENT

Figure 1:
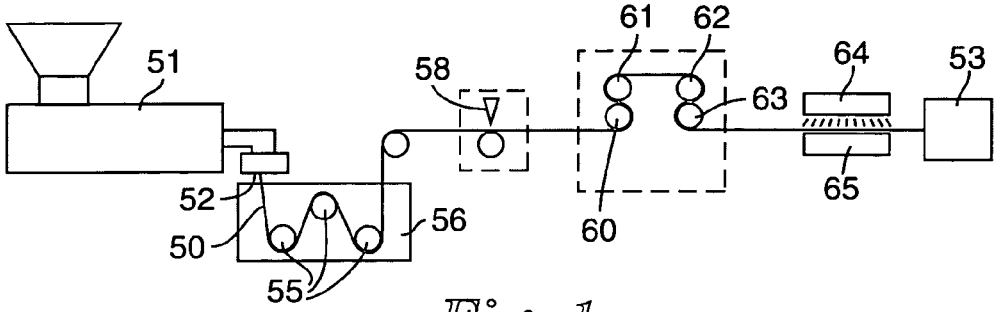
FIG. 1 schematically illustrates a method for making a hook strand such as shown in FIGS. 2–16.
Figure 2:
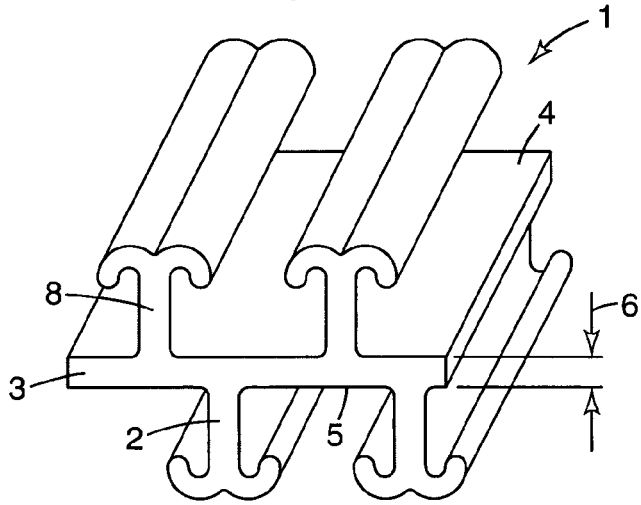
FIG. 2 is a perspective view of a precursor film used to make the hook strand of FIG. 4.
Figure 3:
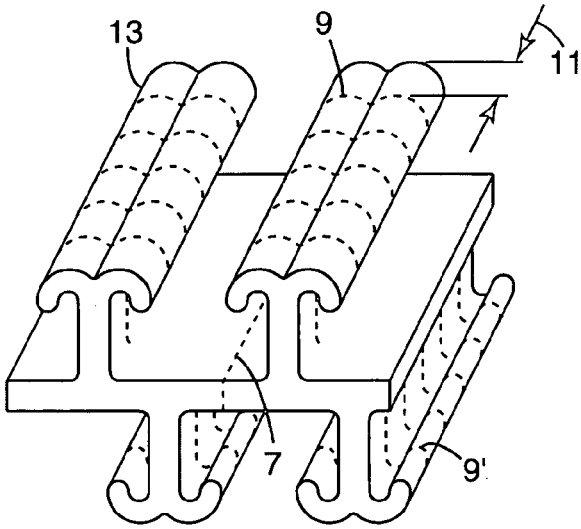
FIG. 3 is a perspective view of a first embodiment cut precursor film in accordance with the present invention.
Figure 4:
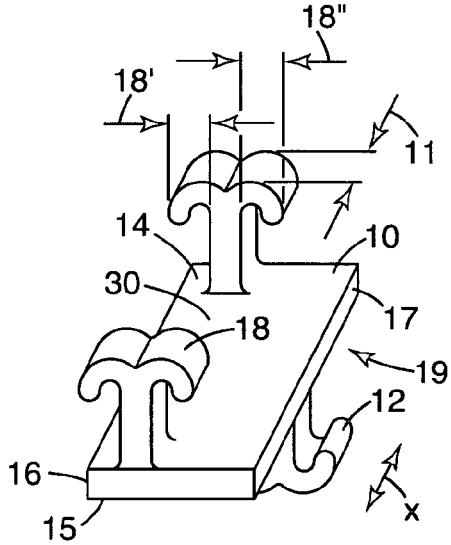
FIG. 4 is a perspective view of a first embodiment hook strand in accordance with the present invention.

The hook strands are preferably made by a novel adaptation of a known method of making hook fasteners from an extruded profiled film having hook forming ribs as described, for example, in U.S. Pat. Nos. 3,266,113; 3,557,413; 4,001,366; 4,056,593; 4,189,809 and 4,894,060 or alternatively U.S. Pat. No. 6,209,177. A first embodiment of a method for forming a film usable in forming the invention strands, is schematically illustrated in FIG. 1. Generally, the method includes first extruding a strip or strand 50 such as the strip 1, shown in FIG. 2, of thermoplastic resin from an extruder 51 through a die 52 having an opening cut, for example, by electron discharge machining, shaped to form the strip 50 with a base layer 3, and elongate spaced ribs 2 and/or 8 projecting from at least one surface 4 or 5 of the base layer 3 that have a predetermined hook cross sectional shape. If desired, a second set of ridges or ribs 8 can be provided on the second surface 4 of the base layer 3 which second set of ridges can have a predetermined shape of a desired hook portion or element. The strip 50 is pulled around rollers 55 through a quench tank 56 filled with a cooling liquid (e.g., water), after which the ridges 8 and 2 are transversely slit or cut at spaced locations 9 or 9' along their lengths by a cutter 58 to form discrete cut portions 13 of the ribs or ridges 2 and/or 8. The distance between the cut lines 11 corresponds to about the desired width 11 of the hook elements to be formed, as is shown in FIG. 4. The cuts 9 and 9' can be at any desired angle, generally from 90° to 30° from the lengthwise extension of the ribs or ridges 2 and 8. Optionally, the strip can be stretched prior to cutting to provide further molecular orientation to the base layer 3 or ridges 2 and 8 and reducing the size of the ridges or ribs 2 and 8 or the base layer thickness 6 and also reducing the size of the subsequent hook elements formed by slitting of the ridges. The cutter 58 can cut using any conventional means such as reciprocating or rotating blades, lasers, or water jets, however preferably it cuts using blades oriented at an angle of about 60 to 90 degrees with respect to lengthwise extension of the ridges or ribs 2.

After cutting of the ridges or ribs 2, 8 the strip 1, 50 is longitudinally stretched at a stretch ratio of at least 1.5, and preferably at a stretch ratio of at least about 3.0, preferably between a first pair of nip rollers 60 and 61 and a second pair of nip rollers 62 and 63 driven at different surface speeds. This forms the hook element members 18 and 12. Optionally, the strip 50 can also be transversely stretched to provide orientation to the base 3 in the cross direction. Roller 61 is preferably heated to heat the base 3 prior to stretching, and the roller 62 is preferably chilled to stabilize the stretched base 3. Stretching causes spaces 30 between the cut portions 13 of the ribs or ridges, which cut portions then become the hook elements 12 and 18 on the finished hook strand 19. The base layer 3 is then separated such as with a slitter 53 lengthwise along a cut line 7 between the ridges, causing the base layer to separate into strands. The base layer can also be cut or slit prior to longitudinal orientation, in which case each individual strand is oriented longitudinally. The hook elements formed are generally rectilinear having two opposing flat faces. The base layer also can be rectilinear. The hook elements 18 and 12 extend from a front face 14 and a back face 15 of the strand 19. The hook elements could be directly opposite each other or offset, based on the location of the cuts formed on each of the ribs or ridges 2 and 8. If the cuts are directly opposite each other on both faces the hook elements formed from the cut portions of the opposing ridges will be directly opposite each other. If the cuts are offset, the hook elements will be offset.

Formed hook elements can also be heat treated preferably by a non-contact heat source 64. The temperature and duration of the heating should be selected to cause shrinkage or thickness reduction of at least the head portion by from 5 to 90 percent. Heating is preferably accomplished using a non-contact heating source which can include radiant, hot air, flame, UV, microwave, ultrasonics or focused IR heat lamps. This heat treatment can be over the entire strip containing the formed hook portions or can be over only a portion or zone of the strip. Or, different portions of the strip can be heat treated to more or less degrees of treatment. In this manner, it is possible to obtain on a single hook strip areas with different levels of performance without the need to extrude different shaped rib profiles. This heat treatment can alter hook elements continuously or in gradients across a region of the hook strip. In this manner, the hook elements can differ continuously across a defined area of the hook member. Further, the hook density can be the same in the different regions coupled with substantially the same film backing caliper or thickness (e.g., 50 to 500 microns). The caliper can easily be made the same as the hook strip and will have the same basis weight and same relative amount of material forming the hook elements and backing in all regions despite the difference in the shape of the hooks caused by the subsequent heat treatment. The differential heat treatment can be along different rows or can extend across different rows, so that different types of hooks, such as hooks having different hook widths, can be obtained in a single or multiple rows in the machine direction or the lengthwise direction of the hook strip. The heat treatment can be performed at any time following creation of the hook element, such that customized performance can be created without the need for modifying the basic hook element manufacturing process. With all of these hook shapes, the hook shape and dimensions can be altered following formation by heat treatment of at least the hook elements. Heat treatment tends to shrink the hook width in the direction that the ribs were extruded by relaxing any molecular orientation in the hooks as a result of the extrusion of the ribs. In this case the width of the hooks can be less than that of the strands from which the hooks project.

The hook elements will generally have rectilinear hook engaging arms and stems that are rectilinear. However, only the stems could be rectilinear if, for example, the stems are formed from ridges or a base layer without an overhang and/or lip element and the overhang is created after the formation of the stems such as by selective capping. Capping could be accomplished by using a heated nip or other mechanism (employing heat optionally with pressure) to deform the tip of a stem to form overhangs in one or more directions. The deformation could be in a multitude (three or more) directions or in the form of a mushroom (many or all radial directions). Examples of patents describing various capping techniques include U.S. Pat. No. 5,077,870 (Melbye et al.); U.S. Pat. No. 6,000,106 (Kampfer) and U.S. Pat. No. 6,132,660 (Kampfer).

Suitable polymeric materials from which the hook strands of the invention can be made include thermoplastic resins comprising polyolefins, e.g. polypropylene and polyethylene, polyvinyl chloride, polystyrene, nylons, polyester such as polyethylene terephthalate and the like and copolymers and blends thereof. Preferably, the resin is a polypropylene, polyethylene, polypropylene-polyethylene copolymer or blend thereof. Generally, these resins are inelastic which allow orientation of the uncut portion of the film base layer or ridges. Generally, the strand base layer will have a thickness of from 25 to 150 μm, preferably 25 to 100 μm.

The formed hook strand 19 shown in FIG. 4 has a continuous longitudinal base layer 10 having a front face 14, a back face 15 and two side faces 16 and 17. The base layer 10 is comprised of a thermoplastic resin. Generally, the hook elements are also formed of the same thermoplastic resin but could be a different resin by using, e.g., a coextrusion process as is well known in the art. If multilayering is desired, it is possible that the strand backing portion comprises a thermoplastic elastic material. The individual hook elements 18 and 12 are on opposite faces (14 and 15) of the base layer 10 and have hook engaging overhangs or arms 18' and 18" which extend at a direction transverse to the longitudinal extent x of the base layer. Preferably, the hook engaging arms 18' and 18" will extend at an angle from 20° to 90°, preferably from 30° to 90° from the longitudinal extend x of the base layer. This is important in that the hook engaging arms do not extend in the same direction as the base layer making the hook engaging arms more readily accessible by suitable loop structures and the like.

Figure 5:
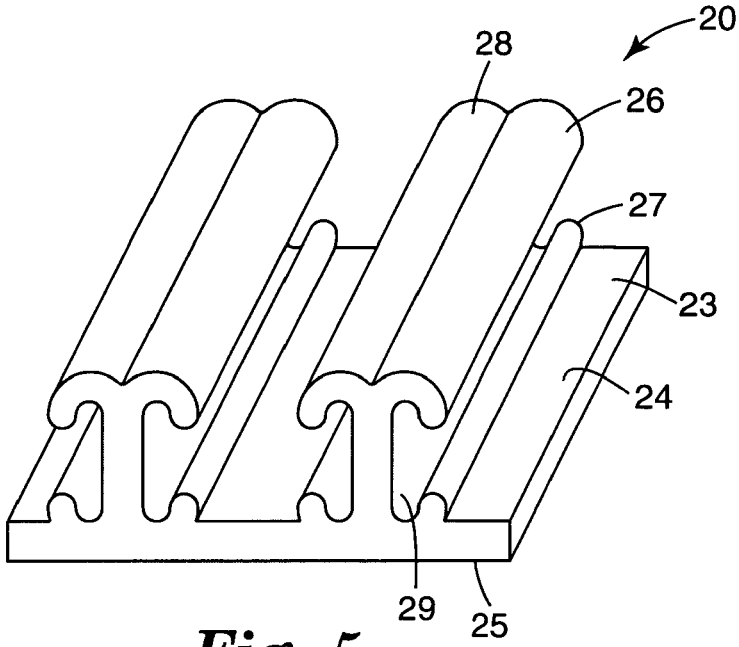
FIG. 5 is a perspective view of a second embodiment precursor film used to make a hook strand as shown in FIG. 7.
Figure 6:
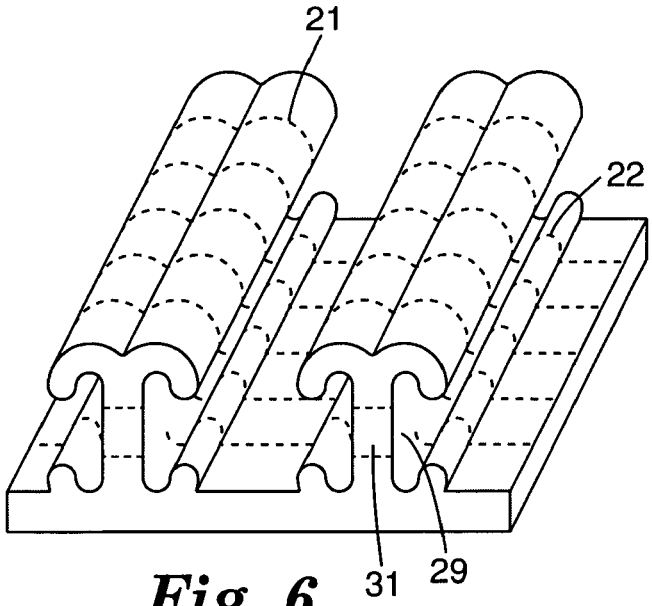
FIG. 6 is a perspective view of a second embodiment cut precursor film in accordance with the present invention.
Figure 6A:
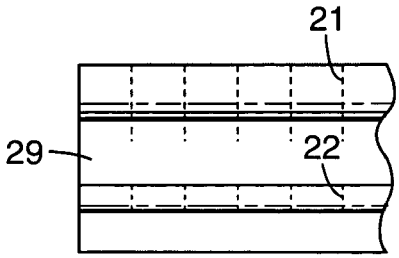
FIG. 6*a* is a side view of a second embodiment cut precursor film in accordance with the present invention.
Figure 7:
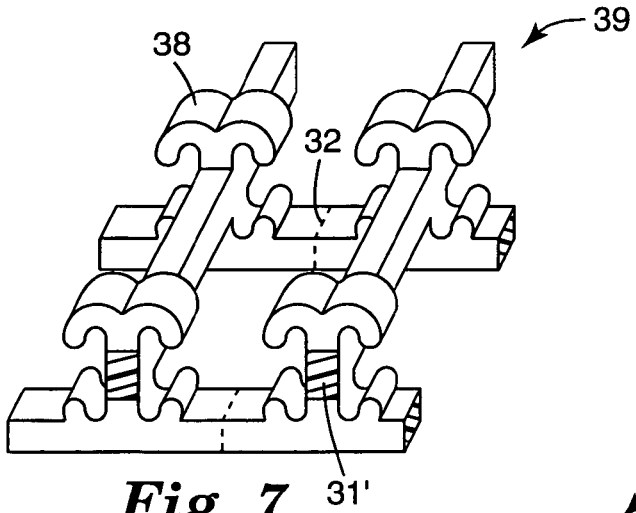
FIG. 7 is a perspective view of a further intermediate cut stretched precursor film in accordance with the second embodiment.
Figure 8:
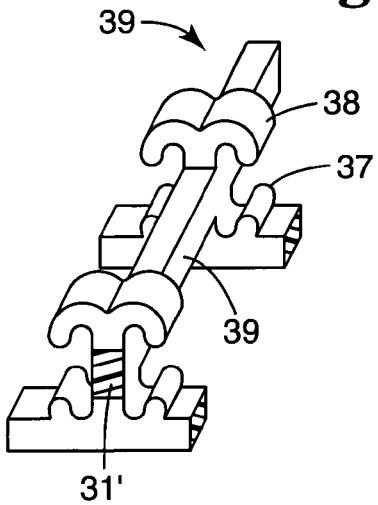
FIG. 8 is a perspective view of the second embodiment hook strand in accordance with the present invention.
Figure 9:
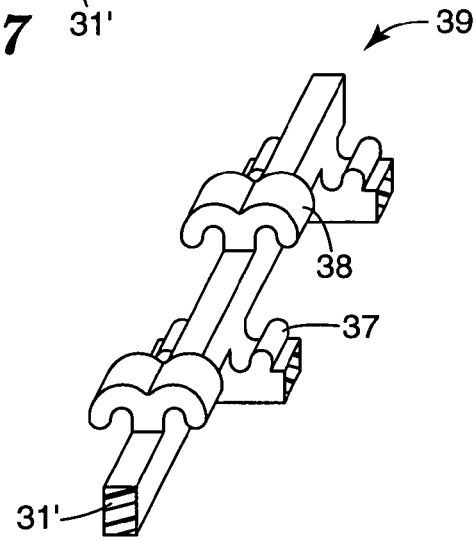
FIG. 9 is a perspective view of a third embodiment hook strand obtainable from the second embodiment precursor film of FIG. 5.

A second embodiment precursor film is shown in FIG. 5. The precursor film 20 has a backing 23 having a front face 24 and a back face 25. The front face 24 has a series of ridges 28 extending in the longitudinal direction which have precursor hook loop engaging arms or overhangs 26 at the terminal end of a precursor stem portion 29 and precursor hook forming lips 27 adjacent the ridges formed directly on the backing. The lips 27 can be on one or both sides of the ridges, and are in close proximity to the ridges to form functional hook overhangs or hook engaging arms. As shown in FIG. 6, this precursor film 20 is cut on opposite faces partially cutting into the ridges on one face, as shown with cut lines 21, and cutting the backing layer 23, as shown with cut lines 22, on the opposite face leaving a portion 31 of the stem precursor 29 uncut. This uncut portion of the stem precursor 29 of the ridges 28 eventually will form the continuous backing of the final formed strand. The uncut portions 31 of the stems 29 form the hook strand base layer 31' following the stretching operation as shown in FIG. 7 where the uncut portion 31' is now oriented and the overhanging portions 26 of the ridges 28 have been formed into hook elements 38. The lips 27 on the backing then form hook engaging arms 37, which arms 37 are created from the backing layer after the oriented film is further cut longitudinally along longitudinal cut lines 32. An alternative embodiment of this type of hook strand is shown in FIG. 9 where instead of the film backing 23 and ridges 28 being cut at the same relative location in the longitudinal web direction they are cut in an offset manner resulting in offset separation of the hook engaging elements 38 and 37 along strand 39. In both embodiments, FIGS. 8 and 9, the cut frequency of the cut portion shown is equal along the length of the precursor film resulting in equally spaced cut portions that result in creation of equally spaced hook elements 38 and 37 on opposite faces of the strand 39, however, the cut frequency can be random or at different spacings resulting in hook elements having different widths or frequencies along the longitudinal length of the strand backing 31'. Having hook elements on opposite faces of the strand 39 will increase the number of hook elements per unit length of the strand. The width of the individual hook engaging portions is determined by the cut frequency or the width of the cut portions. The spacing between individual hook elements will be determined by the stretch ratio coupled with cut frequency. As such, the hook elements size and spacing on opposite faces of the strand can be independently determined by the variations in the cut frequencies on opposite faces of the precursor film.

Figure 10:
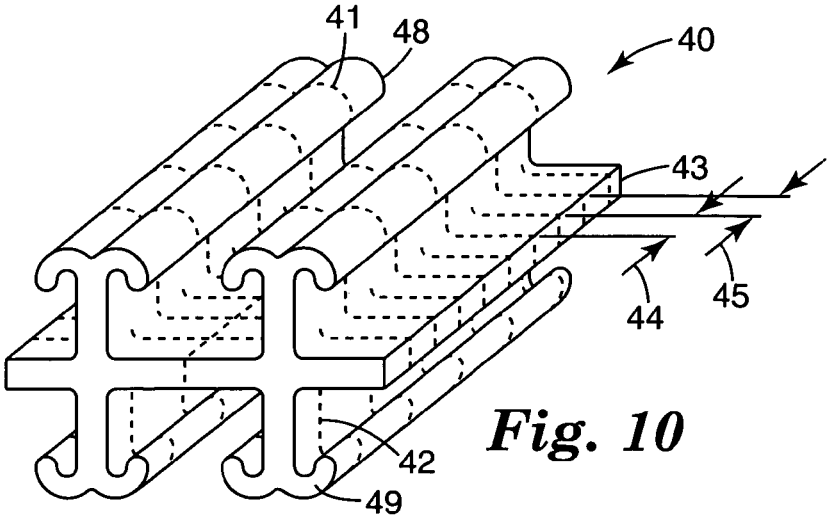
FIG. 10 is a perspective view of a third embodiment cut precursor film in accordance with the present invention.
Figure 10A:
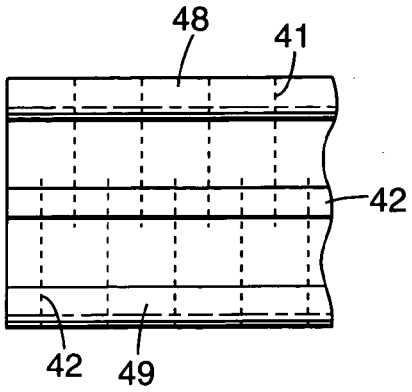
FIG. 10*a* is a side view of a third embodiment cut precursor film in accordance with the present invention.
Figure 11:
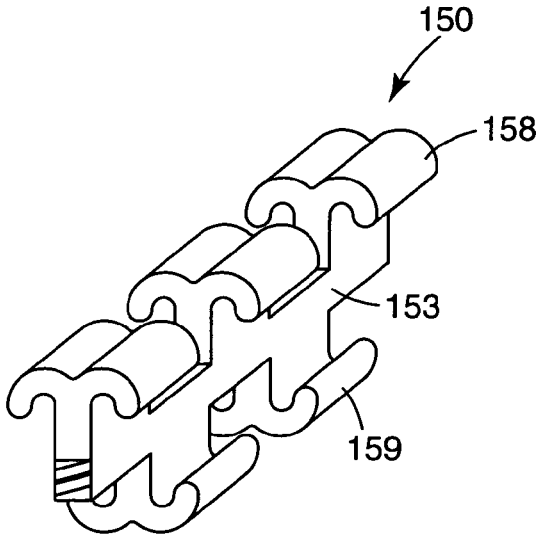
FIG. 11 is a version of a hook strand produceable from the third embodiment precursor film in accordance with the present invention having alternating cuts on either face of the precursor film.

FIG. 10 represents a third alternative embodiment precursor film cut in a particular novel manner where ribs or ridges 48 and 49 are provided in generally mutually opposing relation on opposite faces of a film backing 43. The individual ribs and the backing are cut through on either face at identical spacings and frequencies, but offset by a predetermined distance 44. The backing or base layer is substantially cut entirely through on both faces but in an alternating pattern and into the opposing ridge in whole or in part but never to a point that the film is entirely cut through. The hook strip backing 153 is formed by the partially uncut alternating portions of the stem regions of the ridges 48 and 49, substantially as shown in FIG. 11, connected by the cut portion of the backing and ridges. The hook strand 150 has hook elements 158 and 159 on opposite faces formed from the ridges 48 and 49 respectively.

Figure 12:
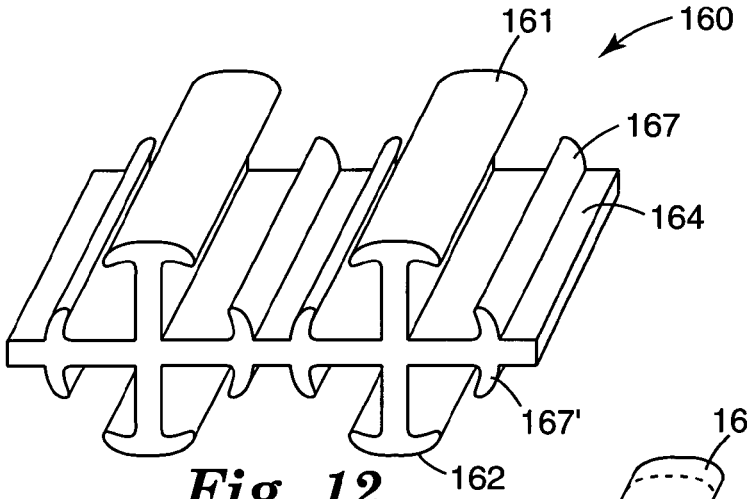
FIG. 12 is a fourth embodiment precursor film in accordance with the present invention.
Figure 13:
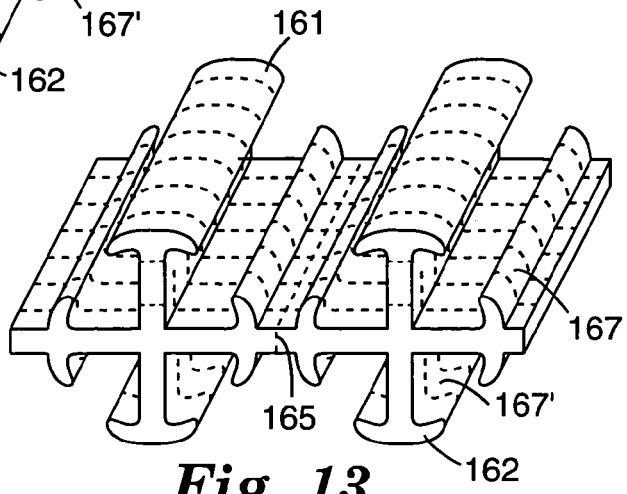
FIG. 13 is a perspective view of a cut precursor film of FIG. 12 in accordance with the present invention having cuts on both the top and bottom face of the precursor film.
Figure 14:
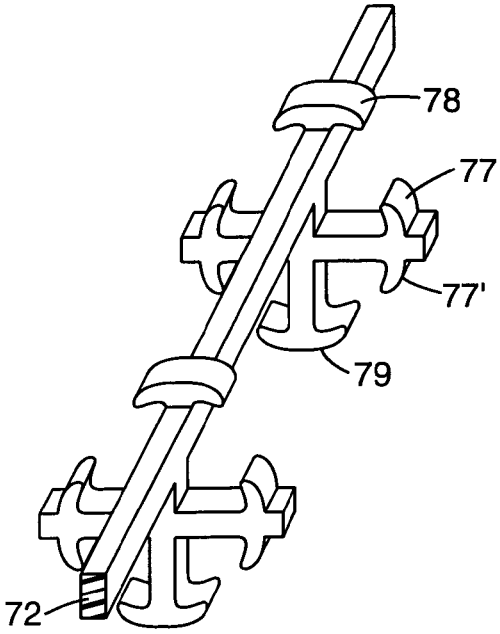
FIG. 14 is an embodiment of a hook strand produceable from the fourth embodiment precursor film of FIG. 13.
Figure 16:
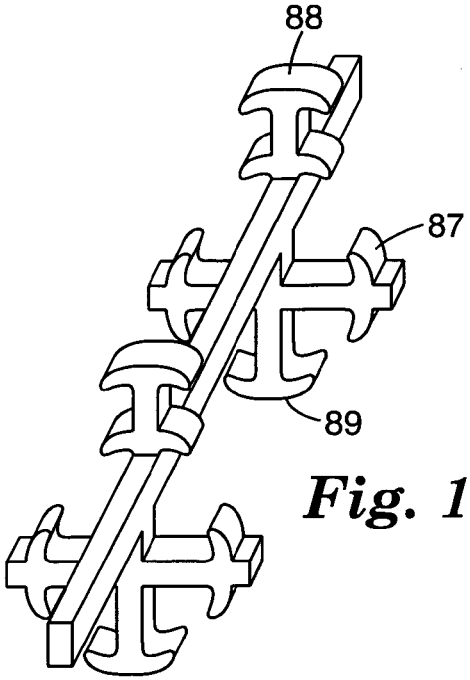
FIG. 16 is a perspective view of a hook strand produceable from the fifth embodiment precursor film of FIG. 15 cut similarly to the hook strand FIG. 14.
Figure 17:
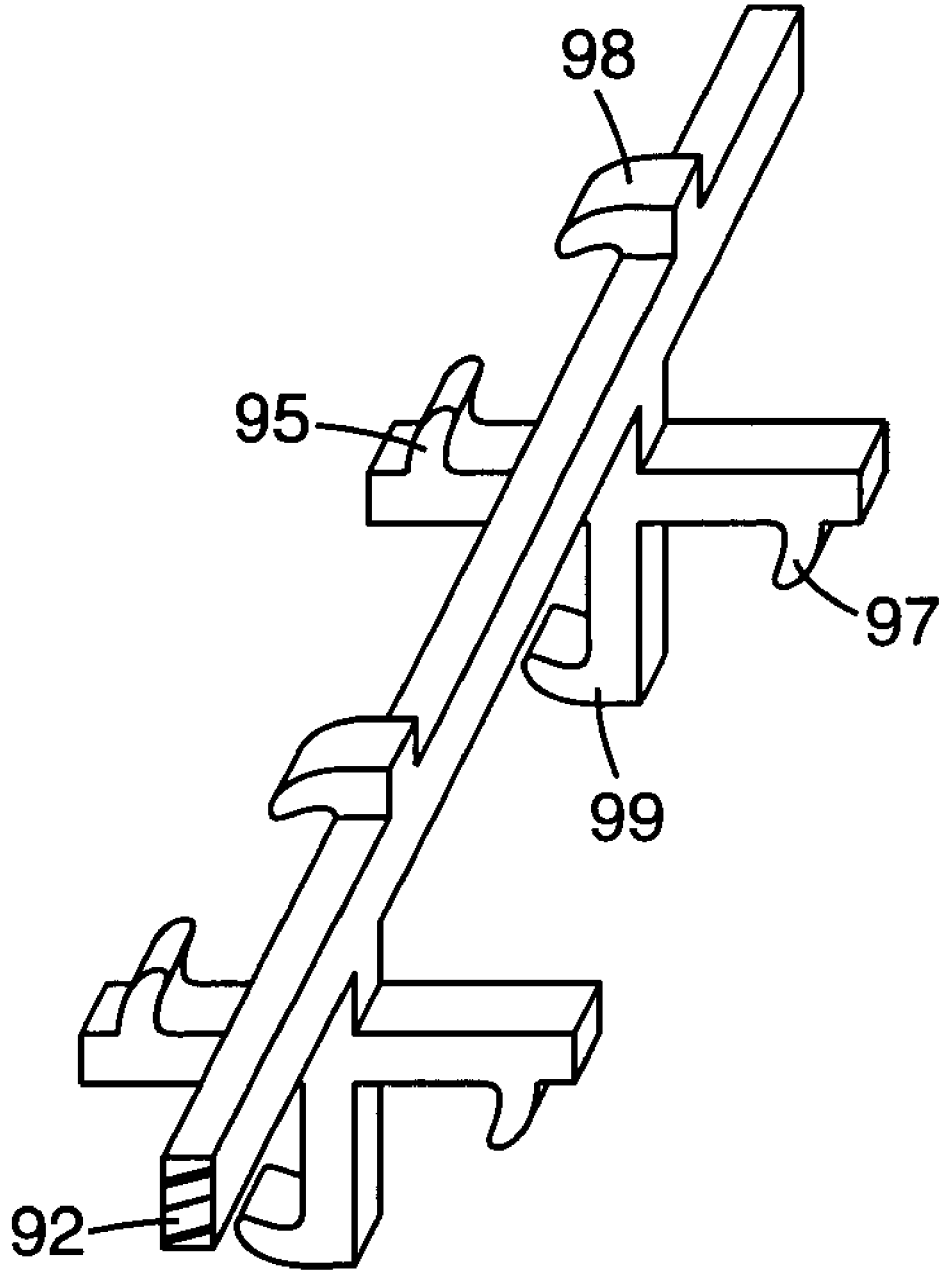
FIG. 17 is a further embodiment of a hook strand similar to that of FIG. 16 produced from an alternative embodiment precursor film not shown.

FIG. 12 is a fourth embodiment of a precursor film used in accordance with the present invention, similar to the FIG. 5 precursor film, however having hook forming ridges 161 and 162 on opposite faces of the base layer. Like the embodiment shown in FIGS. 5–9, the hook strand base layer is formed from the same material as the ridge 161. The additional hook precursor lips 167 and 167' result in formation of a hook strand which has hooks extending in four directions. This provides a hook element which has substantially higher concentration of hook engaging elements per unit length. Hooks extending in two or more directions are important in hook strands used to form nonwoven webs where the strands get randomly twisted and/or entangled. As the fiber or strand twists, hooks on a given face rotate out of plane which can cause them to be directed into the web rather than outward. If a secondary hook is on the opposite face, engagement is possible with that hook. As such, hooks on three or more faces of the strand further increase the probability of a given hook being outwardly facing regardless of the degree of twist in a fiber. The fibers can also be directly formed into a fibrous web for example by partial splitting or total splitting followed by hydroentangling. The higher concentration of hook elements per unit length increases the probability of hook elements being outwardly extending from the surface of the nonwoven or woven material. The probability of the hook elements outward extending in a web is increased when the hook elements extend in more than two directions, particularly three or more directions as shown in FIGS. 14, 16 and 17 embodiments. In these embodiments there can be from about 10 to 50 hook elements per centimeter of strand length or preferably 20 to 40. Generally, with the invention strands the concentration of hook elements per centimeter is 5 or more, preferably 10 or more.

The hook strands can comprise a composite web with a woven web where the composite web is formed by processes such as hydroentangling. The hook strands can also comprise a nonwoven composite web where in the hook strands are blended with other fibers in well-known nonwoven forming processes such as carding, melt blowing or spunbonding. The fibers with which the hook strands are blended can be elastic, inelastic, heat sealable, crimped, noncrimped or any other type of fiber or blend. Such a composite web would be useful in articles such as a self-adhering medical wrap or for bundling strap-type applications. A hook strand composite web could also form a closure element for use in a disposable article such as a diaper, a feminine hygiene article, a medical gown, surgical wrap or like articles. The composite web provided for another purpose, for example, such as the nonwoven outer cover, or nonwoven elastic or nonelastic ear portion, of a diaper, the engaging flap of a feminine hygiene pad, or a nonwoven belt where the composite web could engage with itself or a separately provided nonwoven. The composite web could also be provided with at least one other element as a laminate, such as with tapes, elastic webs, hook films, loop fabrics or the like.

Figure 15:
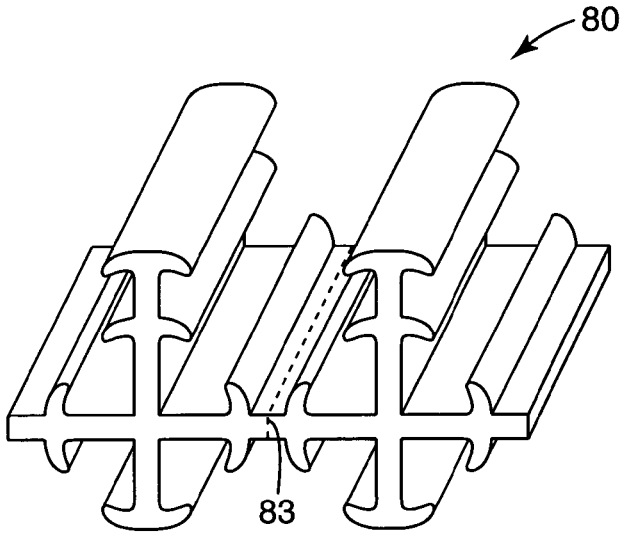
FIG. 15 is a perspective view of a fifth embodiment precursor film in accordance with the present invention.

FIG. 15 is a further embodiment of the precursor film for forming a strand element such as shown in FIG. 16 having hook engaging elements extending in four directions. Additional hook engaging arms are provided on the hook elements 88 by having additional hooking forming lips formed on the precursor rib or ridge from which the hook element is cut. This can also be used to provide additional hook engaging arms on the hook elements 89 and 87 as would be apparent to one skilled in the art by providing additional lip structures on these additional ridges or on the backing. Hook engaging elements can extend in more than four directions by having additional ridges extending from a common base or base region. For example, two or more ridges could extend from a single backing face, such as in a V-type wedge. In all the embodiments discussed above the ridges are provided with at least two hook engaging arms, however, if desired, directionality can be provided by providing hook engaging arms in only one direction such as shown in FIG. 17 where the hook elements 98, 97, 95 and 99 have hook engaging overhangs extending only in a single direction. These can be all in the same direction or different directions as shown in FIG. 17.

Test Methods

Shear Strength

The performance of the hook strands was measured using a dynamic shear test. Two—15 cm long by 2.5 cm wide strips of nonwoven loop material (sold under the designation KN-1971 by the 3M Co., St. Paul, Minn.) were cut from a larger web of material. 5.1 cm long samples of the stranded hook materials were prepared. A sample of stranded hook was placed on top of the nonwoven side of the loop material and then engaged into the nonwoven by placing a 4 Kg weight onto the hook and nonwoven and then twisted several times back and forth. A second strip of the loop material was then placed, nonwoven side down, on top of the hook/nonwoven laminate, and then engaged with the laminate by twisting a 4 Kg weight back and forth on top of the 3 components. The 3 component laminate was then mounted in an INSTRON constant rate of extension testing machine (Model 1122 available from the Instrom Corporation, Canton, Mass. 02021) with a nonengaged end of the first strip of loop material in the upper jaws and the other nonengaged end of the second strip of loop material in the lower jaws of the test machine in an overlap shear geometry. The jaws were separated at a rate of 30.5 cm/min with the maximum load recorded in grams. 10 replicates were tested and averaged together and are presented in Table 1 below. The Example 1 material having hook elements on two sides of the strands exhibited approximately 12 times the shear strength as that of Comparative Example 1 material which had hooks on only 1 side of the strand.

EXAMPLES

Example 1

A profiled hook web was made using apparatus similar to that shown in FIG. 1. A polypropylene/polyethylene impact copolymer (C104, 1.3 MFI, Dow Chemical Co., Midland, Mich.) pigmented with a TiO2/polypropylene (50:50) color concentrate at 1% by weight, was extruded with a 6.35 cm single screw extruder (24:1 L/D) using a barrel temperature profile of 177° C.–232° C.–246° C. and a die temperature of approximately 235° C. The extrudate was extruded vertically downward through a die having an opening cut by electron discharge machining to produce an extruded profiled web similar to that shown in FIG. 2. The crossweb spacing of the upper ribs was 7 ribs per cm. After being shaped by the die, the extrudate was quenched in a water tank at a speed of 6.1 meter/min with the water being maintained at approximately 10° C. The web was then advanced through a cutting station where the upper ribs (but not the base layer or the lower ribs) were transversely cut at an angle of 23 degrees measured from the transverse direction of the web. The spacing of the cuts was 305 microns. After cutting the upper ribs, the web was turned over and then the lower ribs were cut down to the upper surface of the base layer. After cutting the upper and lower ribs, the web was longitudinally stretched at a stretch ratio of approximately 3 to 1 between a first pair of nip rolls and a second pair of nip rolls to further separate the individual hook elements to approximately 8 hooks/cm. The thickness of the base layer was 219 microns. The upper roll of the first pair of nip rolls was heated to 143° C. to soften the web prior to stretching. The second pair of nip rolls were cooled to approximately 10° C. The web was then advanced through a slitting apparatus where the base layer was slit between the rows of hook elements to produce strands of hook material having hook elements projecting from two sides of the strands similar to that shown in FIG. 4. The material was then tested for shear performance.

Comparative Example C1

To serve as a comparative example with hook elements projecting from only one side of the strand, a commercially available profile extruded hook (KN-0645, 3M Co., St. Paul, Minn.), with a hook shape similar to that of the upper surface of the web shown in FIG. 4, was slit between the rows of hook elements.

TABLE 1

| Material | Dynamic Shear Strength (grams) |
|---|---|
| C1 | 70 |
| 1 | 900 |

What is claimed is:

1. A thermoplastic hook strand produced by a process comprising the steps of (a) extruding a thermoplastic resin in a machine direction through a die plate having a continuous base portion cavity and one or more ridge cavities extending from at least one face of the base portion cavity, (b) forming a film from the extruded thermoplastic resin, said film having a base film portion with at least two or more hook profiled ridges, (c) cutting the film in a first direction on at least one face through the two or more ridges to form a plurality of cut ridge portions, (d) orienting the cut film portions at least in the direction of the ridges thereby separating the cut ridge portions into discrete upstanding hook members, (e) continuously splitting the film in a second direction substantially along the direction of the two or more ridges so as to form two or more discrete strands having discrete upstanding hook members along the length of the strands the strands having a thermoplastic base layer with at least a first face and a second face with integral discrete hook members formed from thermoplastic resin of the base layer on at least one face in at least one row, the hook elements having hook engaging arms extending at an angle of from 1 to 90 degrees from the longitudinal direction of the strand wherein the base layer is the split oriented thermoplastic resin film.

2. A hook strand of claim 1 wherein the ridges are in the shape of hook members having hook engaging arms extend at an angle of from 30 to 90 degrees from the longitudinal direction of the strand.

3. A hook strand of claim 2 wherein the thermoplastic resin is an inelastic resin.

4. A hook strand of claim 3 wherein the film is in the form of multiple layer thermoplastic resin flow stream.

5. A hook strand of claim 2 wherein the ridges extend from two or more faces of the strand.

6. A hook strand of claim 5 wherein ridges are provided that form hook engaging arms extend from three or more faces of the base layer.

7. A hook strand of claim 1 wherein the ridges are in the shape of hook members having hook engaging arm which extend at an angle of from 1° to 90° from the longitudinal direction of the ridges.

8. A hook strand of claim 1 wherein the hook engaging arms extend from a face of the strand in a single row.

9. A hook strand of claim 8 wherein there are from 10 to 50 hook members per centimeter.

10. A hook strand of claim 8 wherein there art from 20 to 40 hook members per centimeter.

11. A hook strand of claim 1 wherein the hook members are substantially rectilinear.

12. A hook strand of claim 11 wherein the hook members have two opposing flat faces.

13. A hook strand of claim 1 wherein there are at least 5 hook members per centimeter.

14. A hook strand of claim 1 wherein there are at least 10 hook members per centimeter.

15. A hook strand of claim 1 wherein the base layer is essentially flat.

16. A hook strand of claim 1 wherein the base layer is nonplanar.

17. A hook strand of claim 1 wherein the base layer has a thickness of from 25 to 150 μm.

18. A hook strand of claim 1 wherein the base layer has a thickness of from 25 to 100 μm.

* * * * *